United States Patent [19]

Petursson

[11] Patent Number: 4,727,604

[45] Date of Patent: Mar. 1, 1988

[54] WASTE STOPPER ARRANGEMENT

[76] Inventor: S. G. Petursson, 2196 Linby St., Mississauga, Ontario, Canada, L4Y 1V6

[21] Appl. No.: 49,836

[22] Filed: May 15, 1987

[51] Int. Cl.[4] ..... E03C 1/22

[52] U.S. Cl. ..... 4/204; 4/206; 4/286; 4/295

[58] Field of Search ..... 4/204, 203, 199, 295, 4/286, 287, 288, 290, 206, 200, 198; 138/89; 251/100

[56] References Cited

U.S. PATENT DOCUMENTS

| | | | |
|---|---|---|---|
| Re. 16,902 | 3/1928 | Mortimer | 4/295 |
| 1,311,241 | 7/1919 | Newton | 4/200 |
| 1,547,764 | 7/1925 | Kuehl | 4/203 |
| 1,704,510 | 3/1929 | Muend | 4/203 |
| 1,737,804 | 12/1929 | Reedy | 4/203 |
| 2,910,704 | 11/1959 | Kinsey et al. | 4/199 |
| 3,263,243 | 8/1966 | Doyle | 4/203 |
| 4,622,701 | 11/1986 | Petursson | 4/199 |

FOREIGN PATENT DOCUMENTS

| | | | |
|---|---|---|---|
| 561953 | 3/1957 | Italy | 4/203 |

*Primary Examiner*—Henry K. Artis
*Attorney, Agent, or Firm*—D. W. Eggins

[57] ABSTRACT

An improved stopper arrangement is provided, for use with a remote stopper actuating mechanism having a mechanical lever system for raising a central post to which the waste stopper is attached. The improved stopper has a central spindle to which is attached the circular stopper disc by means of which the waste is sealed. A set of guidance vanes located beneath the stopper disc and serving to center it in the waste aperture is separably secured by locking means to the actuating spindle in variable height relationship to the stopper mechanism independently of the stopper. Special cranked tools provide access to the locking means, to preclude vandalization.

6 Claims, 4 Drawing Figures

WASTE STOPPER ARRANGEMENT

BACKGROUND OF THE INVENTION

This invention is directed to a waste stopper arrangement, and in particular a waste stopper arrangement possessing certain vandalization resistant characteristics.

The satisfactory maintenance of public and semi-public washing facilities, such as the hand basins in public lavatories and restaurants is greatly impeded by the occurrence of vandalism, both gross and petty.

One area of petty vandalism which diminishes the effective use of this type of facility is the theft of the waste stoppers. The loss of the stopper greatly reduces the contribution that a properly functioning hand basin can make to public health, besides being a nuisance and an annoyance. Such vandalization occurs even with built-in remote stopper mechanisms.

One known earlier fixture having a number of structural and functional characteristics in common with the present invention is shown in U.S. Pat. No. 1,311,241, Newton, July 29, 1919. This earlier construction shares certain superficial characteristics with the present invention, being rod actuated, and having a locking mechanism in close proximity beneath the stopper disc. However, the stopper of Newton can be readily removed from the associated fixture, merely by manipulating the stopper disc about its axis in association with the actuating mechanism to release the stopper from its actuating rod, and does not require the utilization of any tools to effect such removal. Accordingly, the noted prior arrangement presents little obstacle to vandaliziation by theft of the stopper.

SUMMARY OF THE INVENTION

In accordance with the present invention there is provided an improved waste stopper for use in a waste outlet such as that of a bath or wash hand basin, the waste stopper having a circular stopper disc, a central post to which the disc is attached, for attachment of the stopper in use to a waste actuating post, stopper guide means interposed between the stopper disc and the actuating post comprising a central boss portion having a plurality of guide vanes extending outwardly therefrom in centering relation of the boss within the waste, substantially vandal proof locking means closely underlying the stopper disc and securing the guide means in assembled relation with the actuating post, in combination with simple hand tools of modified form to afford access to the locking means when the stopper is in a normal, raised position.

In one embodiment the locking means comprises a threaded grub screw extending radially through the wall of the boss portion of the guide means to make securing contacting engagement with the adjoining radially outer surface of the stopper central post. The associated tool is an allen key having the longer end thereof provided with a tip portion inclined at a slight angle.

In an alternative embodiment there is provided a locking nut crowning a central portion of the boss and threadedly engaging the stopper central post in jamming engagement therewith when installed. The associated open end wrench has the head end cranked at a slight angle, in the plane of the head.

BRIEF DESCRIPTION OF THE DRAWINGS

Certain embodiments of the invention are disclosed, reference being made to the accompanying drawings, wherein.

DETAILED DESCRIPTIONS OF PREFERRED EMBODIMENTS OF THE INVENTION

Figure 1:
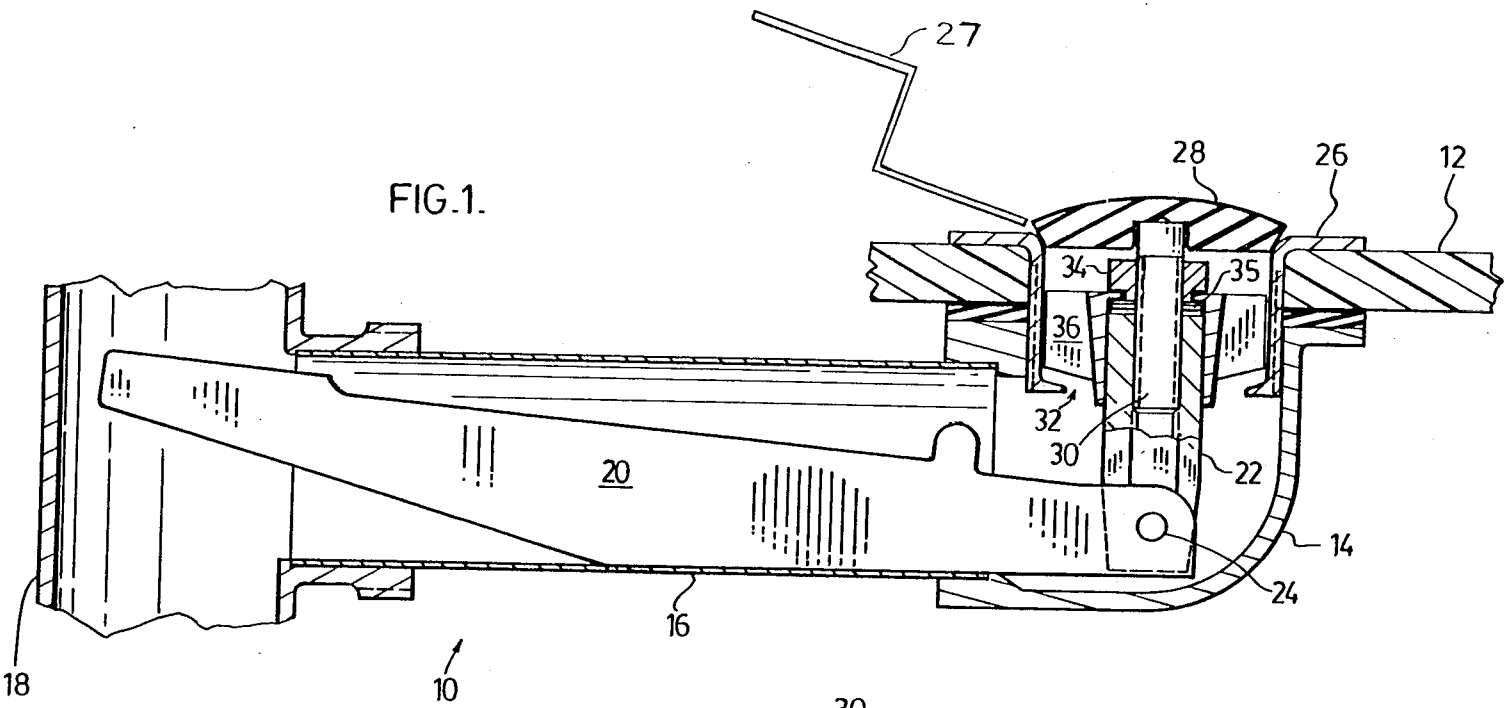
FIG. 1 is diametrical section side view of a waste system incorporating the subject improved waste stopper including a first embodiment of stopper locking means, and the associated tool.
Figure 3:
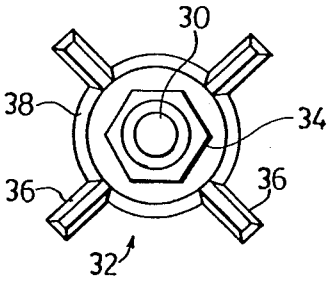
FIG. 3 is a plan view of the subject stopper guide means of the FIG. 1 embodiment.

Referring to FIGS. 1 and 3 a plumbing fixture 12 such as a bath or wash hand basin is provided with a drain having an elbow 14 depending from the fixture 12 connecting with a drain pipe 16 leading to a down pipe 18. The illustrated actuating mechanism comprises a pivot beam 20 having a lifting post 22 secured in pivotal relation to beam 20 by way of pin 24. The post 22 is threaded internally to receive the central post 30 in axially adjustable threaded engagement therein. The central post 30 carries a stopper disc 28 in attached relation therewith.

The relative elevation of the disc 28 in relation to the post 22, and hence with the drain outlet 26 may be readily adjusted by rotation of the disc 28 in an opening or closing sense.

Stopper guide means 32 is mounted by way of its boss portion 38 on the post 22. The guide means 32 has a plurality of guide vanes 36. A locking nut 34 threadedly mounted on the central post 30 engages against the top of the stopper guide means 32 and secures it in sandwiched relation with the actuating post 22, to thereby lock the whole assembly in secured relation for upward and downward displacment, along with stopper disc 28, on actuation of the pivot beam 20. A special cranked open end wrench 27 permits selective loosening or tightening of the nut 34 when the disc 28 is in a fully raised position.

The tops of guide vanes 36 are spaced beneath the stopper disc 28, providing a hair trap therebetween.

Figure 2:
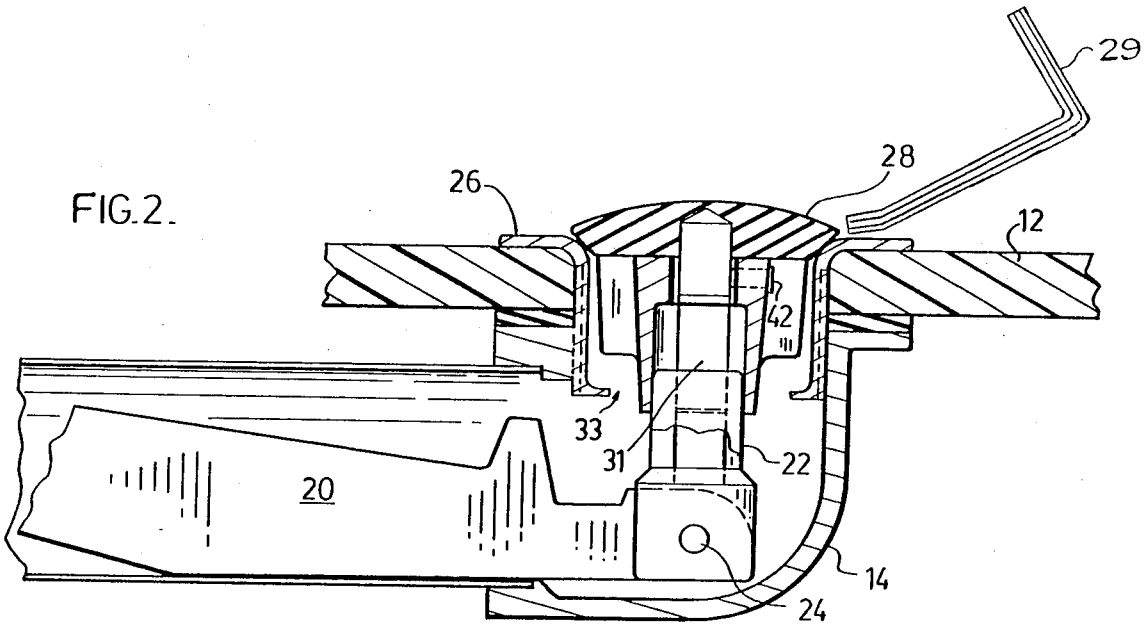
FIG. 2 is a like view, including a second embodiment of stopper locking means, excluding certain extraneous portions, and including the associated allen key.
Figure 4:
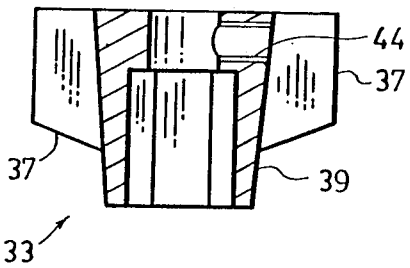
FIG. 4 is a schematic diametrical section of the subject stopper guide means of the FIG. 2 embodiment.

Turning to FIG. 2 and FIG. 4 embodiments, while the same general arrangement is followed, with like components being similarly numbered, the locking means comprises a grub screw 42 set in a threaded passage 44 in the wall of boss portion 39 of the guide means 33. A special cranked-end allen key 29 permits selective loosening or tightening of the set screw 42 when the disc 28 is in a fully raised position.

The guide vanes 37 are shown part way down the boss 39, thereby permitting a range of axial positions for the guide means 33 beneath the stopper.

The extended boss 39 affords protection to the threads of the post 31, by its lower extended end.

It will be understood that certain of the physical characteristics of one embodiment may be incorporated in the other embodiment.

The location of the locking means, manely the grub screw 42 and the locking nut 34 respectively, which are concealed beneath the stopper disc 28 provide a considerable degree of tamper proofing. The nut 34 requires a special flat wrench preferably having the head end thereof cranked in order to effect a satisfactory grip on the nut 34, while the grub screw 42 normally requires the use of an allen key, having an inclined end. Being positively locked, the subject stopper assembly is substantially vandal proofed, against normal extents of tampering or petty theft.

Reverting to the FIG. 1 embodiment, an increase or decrease in the number of spacer washers 35 located on top of actuating post 22 will control the relative vertical location of the stopper guide means 32, serving as variable spacer means therefor, in accordance with the requirements of the fixture.

By providing the lifting post 22 with an hexagonal cross-section, and having the recess of guide means 32, within which the post 22 extends correspondingly shaped, relative rotation of the guide means 32 is positively precluded.

What I claim by Letters Patent is:

1. In combination with a washroom fixture having a waste pipe, a waste outlet within said fixture connected in liquid sealing relation with said waste pipe, a remote actuating mechanism extending within said waste pipe to a location beneath said waste outlet having a waste actuating post extending upwardly towards said waste outlet, a waste stopper having a disc portion to block said outlet when in a closed position, stopper post means interconnecting said disc portion in adjustable axially spaced relation with said waste actuating post, to provide selective upwards displacement of said disc in opening relation with said waste outlet upon actuation of said actuating mechanism, and threaded locking means securing said stopper post to said actuating post in locked relation therewith, said locking means being directly accessible solely through said waste outlet when said disc is in a raised condition, by way of a cranked tool, to preclude unauthorized tampering with said fixture, said actuating mechanism precluding upward withdrawal of said waste stopper from said waste outlet.

2. The stopper as claimed in claim 1, said locking means comprising a locknut securing said stopper guide means to said actuating post.

3. The stopper as claimed in claim 1, said locking means comprising a grub screw securing said stopper guide means to said stopper central post.

4. The stopper as claimed in claim 2, having a plurality of guide vanes in axially spaced relation beneath said stopper disc.

5. The stopper as claimed in claim 1, said guide vanes being axially variably positioned beneath said stopper disc.

6. The stopper as claimed in claim 1 including a plurality of individually removeable spacer means to permit selective axial positioning of said guide vanes relative to said stopper disc.

* * * * *